US008803409B1

(12) United States Patent
Tanaka

(10) Patent No.: US 8,803,409 B1
(45) Date of Patent: Aug. 12, 2014

(54) LAMP DEVICE, LIGHT-EMITTING DEVICE AND LUMINAIRE

(71) Applicant: Toshiba Lighting & Technology Corporation, Yokosuka (JP)

(72) Inventor: Toshiya Tanaka, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 13/832,190

(22) Filed: Mar. 15, 2013

(30) Foreign Application Priority Data

Feb. 5, 2013 (JP) ..... 2013-020311

(51) Int. Cl.
*H01J 5/16* (2006.01)
*F21K 99/00* (2010.01)

(52) U.S. Cl.
CPC ..... *F21K 9/50* (2013.01)
USPC ..... 313/110; 313/112

(58) Field of Classification Search
CPC ..... F21Y 2101/02; F21K 9/50
USPC ..... 313/110, 112, 25, 46
See application file for complete search history.

(56) References Cited

U.S. PATENT DOCUMENTS

2006/0262545 A1 11/2006 Piepgras et al.
2010/0046223 A1 2/2010 Li et al.
2011/0182065 A1 7/2011 Negley et al.

FOREIGN PATENT DOCUMENTS

JP 2012-069363 A 4/2012
WO 2010041287 A1 4/2010
WO 2011156647 A1 12/2011

OTHER PUBLICATIONS

Extended EP Search Report mailed Apr. 16, 2013, EP App 13157823.9.

*Primary Examiner* — Vip Patel
(74) *Attorney, Agent, or Firm* — Banner & Witcoff, Ltd.

(57) ABSTRACT

According to one embodiment, a lamp device includes a base body, a light-emitting module and a lens unit. The base body includes a recess part. The light-emitting module includes a board mounted with a light-emitting element. The board is arranged in the recess part. The lens unit includes a metal surface member to hold a lens. The surface member is arranged in the recess part and is thermally coupled to the base body and the board.

17 Claims, 5 Drawing Sheets

LAMP DEVICE, LIGHT-EMITTING DEVICE AND LUMINAIRE

INCORPORATION BY REFERENCE

The present invention claims priority under 35 U.S.C. §119 to Japanese Patent Application No. 2013-020311 filed on Feb. 5, 2013. The content of the application is incorporated herein by reference in their entirety.

FIELD

Embodiments described herein relate generally to a lamp device using a light-emitting element, a light-emitting device and a luminaire.

BACKGROUND

Hitherto, as a light-emitting device using an LED as a light-emitting element, there is a lamp device in which a board mounted with an LED is arranged in a housing, a lens unit is arranged over the board to face it, and surfaces of the housing and the lens unit are exposed to the outside.

The lens unit includes a lens part on which light generated by the light-emitting element is incident and which controls luminous intensity distribution, and is integrally formed of resin material or the like having transparency.

Although the surface of the lens unit is exposed to the outside, since the lens unit is formed of resin material, the thermal conductivity and heat dissipation are low as compared with metal or the like. Thus, sufficient heat dissipation for heat generated by the light-emitting element is not obtained from the lens unit side.

DETAILED DESCRIPTION

In general, according to one embodiment, a lamp device includes a base body, a light-emitting module, a lens unit, a feeding terminal and a lighting circuit. The base body includes a recess part at one end side. The light-emitting module includes a light-emitting element and a board mounted with the light-emitting element, and the board is arranged in the recess part. The lens unit includes a lens to control luminous intensity distribution of light generated by the light-emitting element and a metal surface member to hold the lens, and is arranged in the recess part so that the surface member is thermally coupled to the base body and the board. The feeding terminal is arranged at the other end side of the base body. The lighting circuit is arranged between the base body and the feeding terminal.

Heat generated by the light-emitting element can be efficiently conducted from the base body and the board to the metal surface member of the lens unit, and can be efficiently radiated from the metal surface member. Thus, heat dissipation from the lens unit can be improved.

Hereinafter, a first embodiment will be described with reference to FIG. 1 to FIG. 6.

Figure 1:
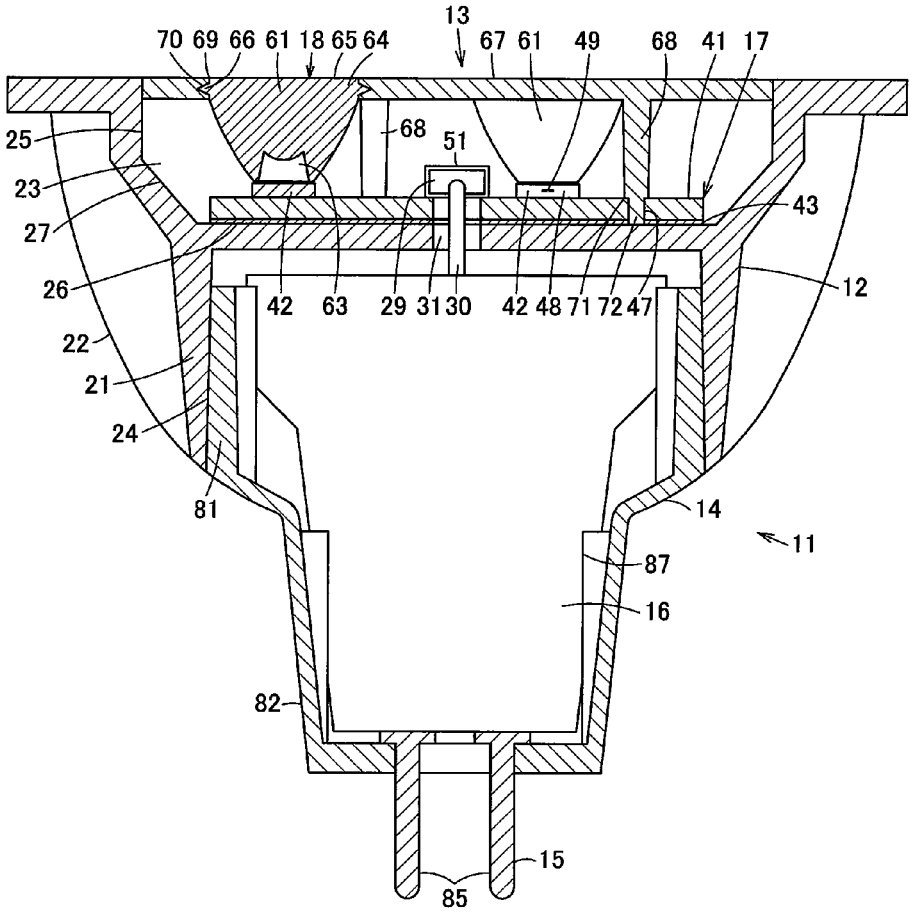
FIG. 1 shows a first embodiment and is a sectional view of a lamp device using a light-emitting device.
Figure 2:
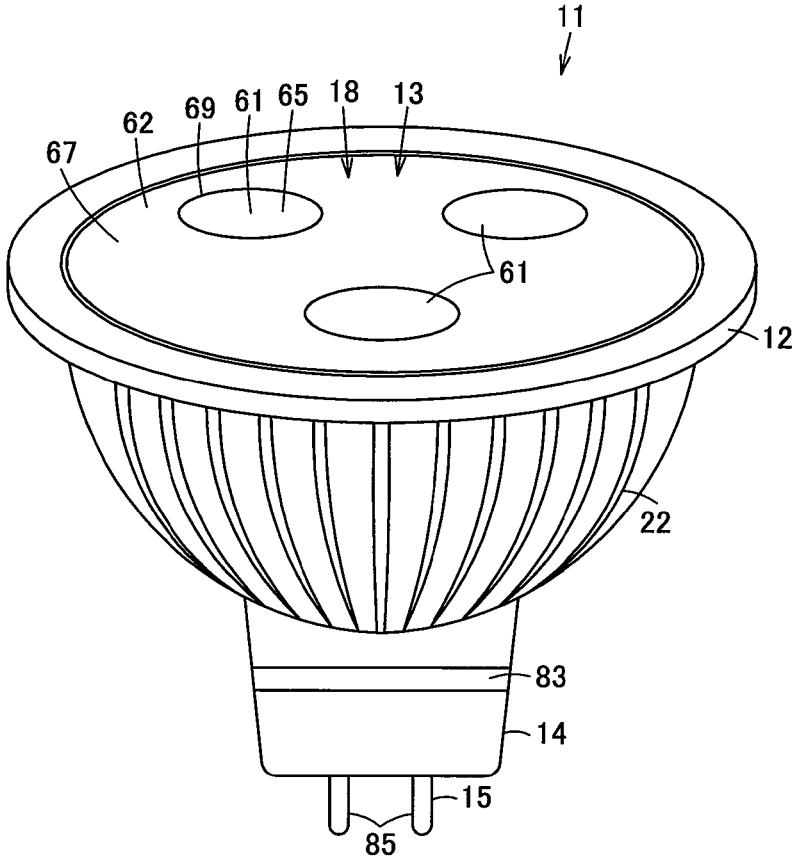
FIG. 2 is a perspective view of the lamp device.

FIG. 1 and FIG. 2 show a lamp device 11. The lamp device 11 is an LED lamp including a base body 12 as a metal thermal radiator, a light-emitting device 13 attached to one end side (one end side of a lamp axis (optical axis) of the lamp device 11) of the base body 12, an insulating cover 14 attached to the other end side of the base body 12 and having insulation properties, a feeding terminal 15 provided at the other end side of the insulating cover 14, and a lighting circuit 16 contained in the insulating cover 14. The light-emitting device 13 includes a light-emitting module 17 attached to the one end side of the base body 12, and a lens unit 18 covering the light-emitting module 17 and attached to the one end side of the base body 12.

The base body 12 is made of a metal material, such as aluminum, excellent in thermal conductivity and is integrally formed into a substantially semispherical shape. A body part 21 opening to the other end side is formed in the center area of the base body, and plural thermal radiation fins 22 along the lamp axis direction are radially protrudingly formed on the periphery of the body part 21. The heat radiation fin 22 is formed to be inclined so that the protruding amount in the radial direction becomes gradually large from the other end side of the base body 12 to the one end side, and is constructed to approximate the shape of a so-called reflector lamp.

A recess part 23 in which the light-emitting device 13 is arranged is formed at one end side of the body part 21 of the base body 12 and is opened to the one end side. A recess part 24 to which the insulating cover 14 is fitted is formed at the other end side of the body part 21 and is opened to the other end side.

The recess part 23 is defined by a cylindrical side surface 25, a circular and plane-shaped attachment surface 26 facing one end side of the base body 12, and an inclined surface 27 to connect the side surface 25 with the attachment surface 26. A not-shown holding part to hold the outer peripheral part of the lens unit 18 (a surface member 67) arranged in the recess part 23 is formed on the side surface 25. A wiring hole 31 through which a connector 29 for electrically connecting the lighting circuit 16 with the light-emitting module 17 and a lead wire 30 pass is opened at the center of the attachment surface 26. Further, a not-shown attachment hole for fixing the light-emitting module 17 by a screw or the like is formed in the attachment surface 26.

Besides, the light-emitting module 17 of the light-emitting device 13 includes a disk-shaped board 41 made of a metal material such as iron or aluminum or an insulating material such as ceramic, and plural light-emitting parts 42 as light sources arranged on a mount surface as one surface of the board 41 at one end side.

Figure 3:
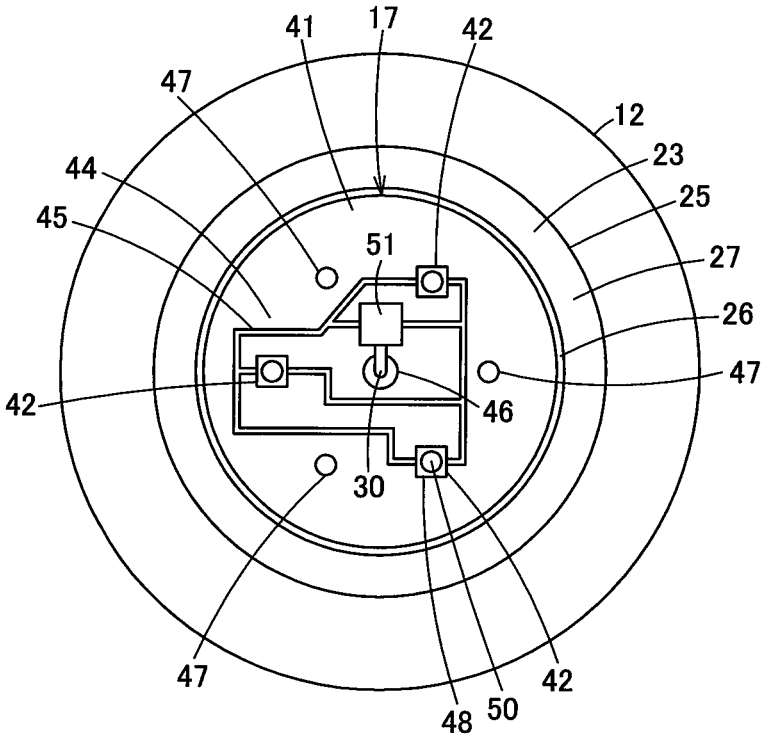
FIG. 3 is a front view in which a lens unit of the lamp device is removed.
Figure 4:
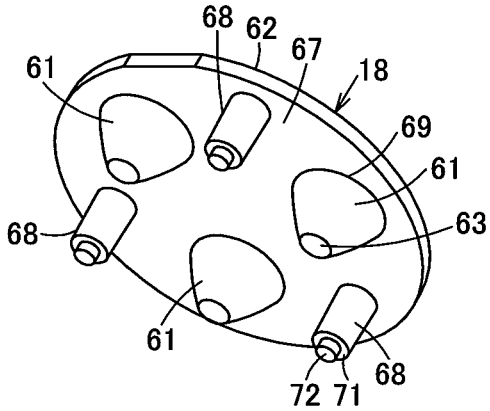
FIG. 4 is a perspective view of the lens unit.
Figure 5:
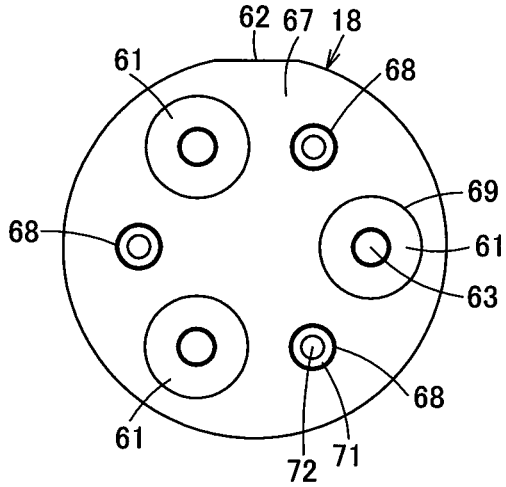
FIG. 5 is a bottom view of the lens unit.

The board 41 is arranged on the attachment surface 26 of the base body 12 through an insulating sheet 43 which is a thin sheet having insulation properties, thermal conductivity and elasticity and made of silicone resin, silicone rubber or the like. The board 41 is thermally connected and fixed to the attachment surface 26 by plural not-shown screws or the like in an insulated state. As shown in FIG. 3, an insulating layer 44 is formed on the mount surface of the board 41, and a wiring pattern 45 is formed on the insulating layer 44. A through-hole 46 communicating with the wiring hole 31 of the base body 12 is opened at the center part of the board 41.

The connector 29 at the lighting circuit 16 side and the lead wire 30 can pass through the through-hole 46. Plural coupling holes 47 for thermal connection with the lens unit 18 (surface member 67) are opened in an area of the board 41 outside the wiring pattern 45. The coupling holes 47 are desirably arranged to be separate from the wiring pattern 45. That is, the separate arrangement is desirably made to such a degree that when insertion parts 72 of after-mentioned support parts 68 are inserted into the coupling holes 47, the support parts 68 do not contact the wiring pattern 45.

The respective light-emitting parts 42 are SMD (Surface Mount Device) packages with connection terminals, which are mounted on the mount surface of the board 41 to be separate from each other. In each of the light-emitting parts 42, an LED element 49 as a light-emitting element is mounted in a recess part provided in abase 48 and is electrically connected to the connection terminal. A sealing resin 50 containing phosphor is filled in the recess part so as to seal the LED element 49 and covers the LED element 49. For example, the LED element 49 emits blue light, and the sealing resin 50 is a transparent resin, such as silicone resin, containing phosphor which is excited by the blue light emitted by the LED element 49 and mainly emits yellow light. Accordingly, the surface of the sealing resin 50 as the surface of the light-emitting part 42 is a light-emitting surface, and whitish illumination light is irradiated from the light-emitting surface. Incidentally, the light-emitting part 42 may be, for example, a so-called COB (Chip On Board) module in which plural LED elements are mounted on the mount surface of the board 41 and the sealing resin 50 covers the whole of the plural LED elements.

Connection terminals of the respective light-emitting parts 42 are electrically connected to the wiring pattern 45 of the board 41. Further, a connector 51 is electrically connected to the wiring pattern 45, and the connector 29 on the lighting circuit 16 side is connected to the connector 51.

Besides, as shown in FIG. 1, FIG. 2, FIG. 4 and FIG. 5, the lens unit 18 of the light-emitting device 13 includes plural lenses 61 corresponding to the plural light-emitting parts 42, and a metal body 62 to integrally hold the plural lenses 61.

The lens 61 is formed of a member such as synthetic resin having transparency or glass. The lens 61 includes an incident part 63 provided at one end side of the lens 61, and an outgoing part 64 provided at the other end side of the lens 61. The lens 61 is a total reflection lens which causes substantially all the light of the light-emitting part 42 incident from the incident part 63 to outgo from the outgoing part 64.

The lens 61 is formed such that the diameter gradually becomes large from the incident part 63 side to the outgoing part 64 side. The outer peripheral surface thereof is a reflecting surface with a curved surface (ellipsoid of revolution or paraboloid) shape to reflect the light to the outgoing part 64. Besides, the incident part 63 includes an incident recess part on which the light from the light-emitting part 42 is incident. Besides, the outgoing part 64 includes a plane-shaped outgoing surface 65 along a direction intersecting (orthogonal) to the lamp axis.

On the peripheral surface of the lens 61, a fitting part 66 to be fitted to the metal body 62 (surface member 67) is formed on the peripheral surface of the outgoing part 64 and at the largest diameter position. The fitting part 66 is a protrusion protruding from the peripheral surface of the lens 61 and is protrudingly provided over all the periphery of the lens 61.

In the metal body 62, the surface member 67 and the plural support parts 68 protruding from the back surface as the other end side surface of the surface member 67 are integrally formed of metal material such as aluminum. In this embodiment, the three support parts 68 are formed on the other end side surface of the surface member 67. They are arranged in a regular triangular shape when the center parts thereof are connected, and are arranged so that the center of gravity of the regular triangle substantially coincides with the center of the surface member 67. As stated above, it is desirable that the plural support parts 68 are provided and are arranged so as to be able to press the board 41 with uniform force.

The surface member 67 is formed into a circular plate shape and can be fitted in the recess part 23 of the base body 41. Plural openings 69 in which the plural lenses 61 are fitted are formed in the surface member 67. Holding parts 70 to hold the fitted lens 61 are formed on the peripheral edges of the openings 69. The holding part 70 is constructed of a groove part in which the fitting part 66 as the protrusion of the lens 61 is fitted. When the lens unit 18 is assembled, the lens 61 is inserted into the opening 69 from the surface side as one end side surface of the surface member 67, and the fitting part 66 of the lens 61 is fitted in the holding part 70, so that the lens 61 and the surface member 67 (metal body 62) can be integrated. In the assembled state, the outgoing surface 65 of the lens 61 and the one end side surface of the surface member 67 are flush with each other.

A not-shown fitting part which is fitted in the holding part provided in the recess 23 of the base body 12 and is fixed is formed on the peripheral surface of the surface member 67. Thus, the peripheral edge part of the surface member 67 is thermally coupled to the base body 12.

The support part 68 is constructed of a strut protruding from the back surface as the other end side surface of the surface member 67 at a position different from that of the opening 69 of the surface member 67 and at a position corresponding to the coupling hole 47 of the board 41. A contact surface 71 as a stepped part which contacts the mount surface of the board 41 is formed at the tip of the support part 68, and an insertion part 72 to be inserted into the coupling hole 47 of the board 41 is formed to protrude from the contact surface 71. The insertion part 72 is press-inserted into the coupling hole 47 and is fixed, or is fixed to the coupling hole 47 by an adhesive such as silicone resin. Accordingly, the plural support parts 68 are fixed to the board 41 and are thermally coupled. The surface member 67 and the board 41 are thermally coupled to each other by the plural support parts 68. Incidentally, the tip of the support part 68 (the insertion part 72) may contact and be thermally coupled to the attachment surface 26 of the base body 12 through the coupling hole 47 and the insulating sheet 43, or may not contact the attachment surface 26 of the base body 12.

Besides, as shown in FIG. 1, the insulating cover 14 is formed of an insulating material, such as PBT resin, into a cylindrical shape opening toward one end side. The insulating cover 14 includes, as one body, a cylindrical main body part 81 to be fitted in the recess part 24 of the base body 12, and a feeding part 82 continuous with the other end side of the main body part 81 and protruding from the recess part 24 of the base body 12. As shown in FIG. 2, a pair of groove-shaped locking recess parts 83 for locking to the socket is provided on the outside surface of the feeding part 82 and at both sides opposite to each other.

The feeding terminal 15 can be connected to, for example, a socket for a GU5.3 type general illumination bulb, and includes a pair of connection pins 85 and 85 protruding from the other end of the insulating cover 14.

The lighting circuit 16 is a circuit to supply constant current to the LED element 49 of the light-emitting module 17. The lighting circuit 16 includes a circuit board 87 on which plural circuit elements constituting the circuit are mounted. The circuit board 87 is inserted along the axial direction of the insulating cover 14, and is stored between the main body part 81 and the feeding part 82 in the insulating cover 14. The connection pins 85 and 85 of the feeding terminal 15 are respectively electrically connected to the input side of the lighting circuit 16. The lead wire 30 having the connector 29 at the tip is connected to the output side of the lighting circuit 16. The connector 29 and the lead wire 30 are pulled out to the mount surface side of the board 41 through the wiring hole 31 of the base body 12 and the through-hole 46 of the board 41, and the connector 29 is connected to the connector 51 of the light-emitting module 17.

Figure 6:
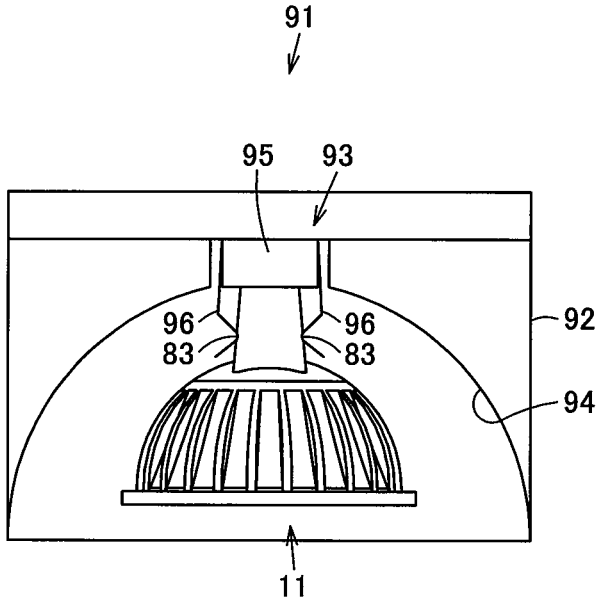
FIG. 6 is a sectional view of a luminaire using the lamp device.

FIG. 6 shows a luminaire 91 as a down light using the lamp device 11. The luminaire 91 includes a luminaire body 92. A socket 93 and a reflector 94 are arranged in the luminaire body 92. The socket 93 includes a substantially cylindrical socket body 95 having insertion holes into which the connection pins 85 and 85 of the feeding terminal 15 of the lamp device 11 are inserted and which are provided with not-shown contacts to which the connection pins are electrically connected. The socket further includes holding springs 96 and 96 movably provided on both sides of the socket body 95. The connection pins 85 and 85 are inserted into the insertion holes and are electrically connected to the contacts, so that the holding springs 96 and 96 are fitted in the locking recess parts 83 and 83 and the lamp device 11 is held by the socket 93.

When the lamp device 11 is mounted to the socket 93 of the luminaire 91 and is energized, the lighting circuit 16 operates, and electric power is supplied to the LED elements 49 of the plural light-emitting parts 42 of the light-emitting module 17. Then, the LED elements 49 emit light, and the light is radiated from the light-emitting part 42. The light radiated from the light-emitting part 42 is incident on the lens 61 from the incident part 63, and outgoes in a specified luminous intensity distribution direction from the outgoing surface 65 of the lens 61.

Besides, heat generated by the LED element 49 at the time of light emission is conducted to the board 41, is conducted from the board 41 to the attachment surface 26 of the base body 12 through the insulating sheet 43, and is radiated to the outside air from the surface of the base body 12 including the plural thermal radiation fins 22.

Part of the heat conducted from the LED element 49 to the board 41 is conducted to the surface member 67 from the plural support parts 68 which are thermally coupled to the board 41, and is radiated to the outside air from the surface of the surface member 67.

Since the peripheral edge part of the surface member 67 is thermally coupled to the base body 12, heat transfers to the low temperature side between the surface member 67 and the base body 12 and is radiated.

As described above, according to the light-emitting device 13 of the embodiment, the heat generated by the LED element 49 can be efficiently conducted from the base body 12 and the board 41 to the metal surface member 67 of the lens unit 18, and can be efficiently radiated from the metal surface member 67 to the outside air. Thus, the heat dissipation from the lens unit 18 can be improved.

Further, the support part 68 can support the surface member 67 relative to the board 41, and can efficiently conduct the heat generated by the LED element 49 from the board 41 to the surface member 67. Besides, the support part 68 includes the contact surface 71 which contacts the mount surface of the board 41, and plural such support parts are formed and are arranged to be able to press the board 41 with uniform force. Thus, the interval between the board 41 and the surface member 67 can be kept the same length at any place. By this, since the interval between the lens 61 and the LED element 49 can be made the same among all the lenses and the LED elements, the characteristic of light outgoing from the lens 61 can be stabilized, and it is possible to suppress the occurrence of such a defect that the lens 61 and the LED element 49 contact each other and the lens 61 made of resin is melted.

In the lamp device 11 using the light-emitting device 13 as described above, the heat generated by the LED element 49 can be radiated from the base body 12, and further, a sufficient heat dissipation effect can be obtained also from the lens unit 18 for radiating light. Thus, the heat dissipation of the whole lamp device 11 can be improved.

Since the lamp device 11 is contained in the luminaire body 92, there is a case where heat dissipation from the base body 12 is not sufficient. However, heat dissipation from the side where the light of the lamp device 11 facing the opening side of the luminaire body 92 outgoes, that is, heat dissipation from the lens unit 18 can be ensured.

Besides, the opening 69 in which the lens 61 is fitted is formed in the surface member 67, and the holding part 70 to hold the lens 61 is formed on the peripheral edge of the opening part 69. Thus, assembling can be easily performed by fitting the lens 61 into the opening 69, and the lens 61 can be certainly held to the surface member 67 in the assembled state.

Figure 7:
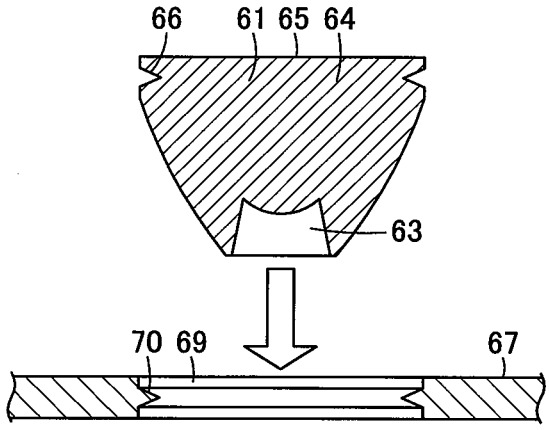
FIG. 7 shows a second embodiment and is a sectional view of a lens unit.

FIG. 7 shows a second embodiment. Incidentally, the same components, operations and effects as those of the first embodiment are denoted by the same reference signs and their explanation is omitted.

A fitting part 66 of a lens 61 is a groove part, and a holding part 70 of a surface member 67 is a protrusion. Also in this case, assembling can be easily performed by fitting the lens 61 into an opening 69, and the lens 61 can be certainly held to the surface member 67 in the assembled state.

Figure 8:
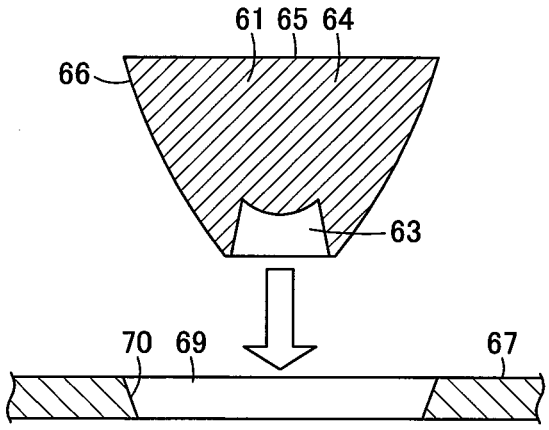
FIG. 8 shows a third embodiment and is a sectional view of a lens unit.

FIG. 8 shows a third embodiment. Incidentally, the same components, operations and effects as those of each embodiments are denoted by the same reference signs and their explanation is omitted.

A fitting part 66 is constructed of an outer peripheral surface of a lens 61, and a holding part 70 is formed on a fitting surface to which the outer peripheral surface of the lens 61 is fitted. The fitting part and the holding part are bonded and fixed by an adhesive such as silicone resin.

Incidentally, one lens 61 of the lens unit 18 may be provided at the center, or two or more lenses may be provided.

Besides, four support parts 68 may be arranged so as to form a square shape, or plural support parts may be irregularly arranged. The support part 68 may be united by bonding it to the surface member 67 by welding or the like.

The feeding terminal 15 of the lamp device 11 is not limited to the connection pin 85, and may be an Edison type cap.

The light-emitting device 13 can be applied to a luminaire other than the lamp device 11 or to other devices.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. A lamp device comprising:

a metallic base body including a recess part at one end side;

a light-emitting module including a light-emitting element and a board mounted with the light-emitting element and formed with a coupling hole, in which the board is arranged in the recess part;

a lens unit including a lens to control luminous intensity distribution of light generated by the light-emitting element, a metal surface member to hold the lens, and a plurality of metallic support parts supporting the surface member relative to the board and thermally coupling the surface member to the board, wherein the support parts include a contact surface brought into contact with the board and an insertion part inserted into the coupling hole of the board, in which the surface member is arranged in the recess part and is thermally coupled to the base body and the board;

a feeding terminal arranged at the other end side of the base body; and a lighting circuit arranged between the base body and the feeding terminal.

2. The lamp device according to claim 1, wherein the base body includes an attachment surface arranged with the board, and a tip of the insertion part brought into contact with the attachment surface and thermally coupled with the board.

3. The lamp device according to claim 1, wherein a contact surface that contacts the board is provided on a tip side of the support part.

4. The lamp device according to claim 1, wherein the board includes a coupling hole, and an insertion part inserted in the coupling hole is provided on a tip of the support part.

5. The lamp device according to claim 1, wherein a plurality of the support parts are provided on the surface member, and the plurality of the support parts are arranged to be able to press the board substantially uniformly.

6. The lamp device according to claim 1, wherein the surface member includes an opening in which the lens is fitted, and a holding part to hold the lens provided on a peripheral edge of the opening.

7. A light-emitting device comprising:

a light-emitting module including a light-emitting element and a board mounted with the light-emitting element and formed with a coupling hole; and a lens unit including a lens to control luminous intensity distribution of light generated by the light-emitting element, a metal surface member to hold the lens, and a plurality of metallic support parts supporting the surface member relative to the board and thermally coupling the surface member to the board, wherein the support parts include a contact surface brought into contact with the board and an insertion part inserted into the coupling hole of the board, in which the surface member is thermally coupled to the board.

8. The light-emitting device according to claim 7, wherein a contact surface that contacts the board is provided on a tip side of the support part.

9. The light-emitting device according to claim 7, wherein the board includes a coupling hole, and an insertion part inserted in the coupling hole is provided on a tip of the support part.

10. The light-emitting device according to claim 7, wherein a plurality of the support parts are provided on the surface member, and the plurality of the support parts are arranged to be able to press the board substantially uniformly.

11. The light-emitting device according to claim 7, wherein the surface member includes an opening in which the lens is fitted, and a holding part to hold the lens is provided on a peripheral edge of the opening.

12. A luminaire comprising:

a lamp device that includes:

a metallic base body including a recess part at one end side;

a light-emitting module including a light-emitting element and a board mounted with the light-emitting element and formed with a coupling hole, in which the board is arranged in the recess part;

a lens unit including a lens to control luminous intensity distribution of light generated by the light-emitting element, a metal surface member to hold the lens, and a plurality of metallic support parts supporting the surface member relative to the board and thermally coupling the surface member to the board, wherein the support parts include a contact surface brought into contact with the board and an insertion part inserted into the coupling hole of the board, in which the surface member is arranged in the recess part and is thermally coupled to the base body and the board;

a feeding terminal arranged at the other end side of the base body; and a lighting circuit arranged between the base body and the feeding terminal; and a socket to which the feeding terminal of the lamp device is connected.

13. The luminaire according to claim 12, wherein the base body includes an attachment surface arranged with the board, and a tip of the insertion part brought into contact with the attachment surface and thermally coupled with the board.

14. The luminaire according to claim 12, wherein a contact surface that contacts the board is provided on a tip side of the support part.

15. The luminaire according to claim 12, wherein the board includes a coupling hole, and an insertion part inserted in the coupling hole is provided on a tip of the support part.

16. The luminaire according to claim 12, wherein a plurality of the support parts are provided on the surface member, and the plurality of the support parts are arranged to be able to press the board substantially uniformly.

17. The luminaire according to claim 12, wherein the surface member includes an opening in which the lens is fitted, and a holding part to hold the lens is provided on a peripheral edge of the opening.

* * * * *